US007334856B2

(12) United States Patent
Hamazaki et al.

(10) Patent No.: US 7,334,856 B2
(45) Date of Patent: Feb. 26, 2008

(54) METHOD OF DRIVING LIQUID-DROP-EJECTING RECORDING HEAD, AND LIQUID-DROP-EJECTING RECORDING DEVICE

(75) Inventors: Toshinobu Hamazaki, Ebina (JP); Toshinori Ishiyama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 344 days.

(21) Appl. No.: 11/208,300

(22) Filed: Aug. 19, 2005

(65) Prior Publication Data

US 2006/0209108 A1 Sep. 21, 2006

(30) Foreign Application Priority Data

Mar. 15, 2005 (JP) ..... 2005-073994

(51) Int. Cl.
*B41J 29/38* (2006.01)
*B41J 2/05* (2006.01)
*B41J 2/045* (2006.01)

(52) U.S. Cl. ..... 347/10; 347/9; 347/11; 347/57; 347/68

(58) Field of Classification Search ..... 347/9, 347/10, 11

See application file for complete search history.

(56) References Cited

U.S. PATENT DOCUMENTS 6,161,912 A * 12/2000 Kitahara et al. ..... 347/10
2002/0047872 A1* 4/2002 Ishikawa ..... 347/10

FOREIGN PATENT DOCUMENTS

| | | |
|---|---|---|
| JP | 10-151770 | 6/1998 |
| JP | 11-170515 | 6/1999 |
| JP | 11-170522 | 6/1999 |
| JP | 2002-326357 | 11/2002 |

* cited by examiner

*Primary Examiner*—Lamson Nguyen
*Assistant Examiner*—Jannelle M. Lebron
(74) *Attorney, Agent, or Firm*—Fildes & Outland, P.C.

(57) ABSTRACT

A liquid-drop-ejecting recording head carries out image recording by applying a jetting pulse having a binary digital driving waveform to a piezoelectric element, providing a vibration wave to liquid accommodated in an accommodating chamber, and ejecting a liquid drop from a eject opening. The liquid-drop-ejecting recording head classifies each pixel in accordance with density data thereof. When recording a pixel belonging to a high density range, plural jetting pulses, whose pulse width is ½ times a natural vibration period of a liquid flow at a flow path of the liquid, are applied within a single printing cycle at an interval which is set in advance in accordance with density data of the pixel.

12 Claims, 7 Drawing Sheets

FIG.6

| DENSITY LEVEL | V1 (V) | PW1 (usec) | PW2 (usec) | Int1 (usec) | Int2 (usec) |
|---|---|---|---|---|---|
| (1) | 15 | 6.0 | 2.0 | | 2.0 |
| (2) | 15 | 6.0 | 2.0 | | 3.0 |
| (3) | 15 | 6.0 | 2.0 | | 4.0 |
| (4) | 15 | 6.0 | | | |
| (5) | 15 | 6.0 | | 12.0 | |
| (6) | 15 | 6.0 | | 9.0 | |
| (7) | 15 | 6.0 | | 6.0 | |

METHOD OF DRIVING LIQUID-DROP-EJECTING RECORDING HEAD, AND LIQUID-DROP-EJECTING RECORDING DEVICE

CROSS-REFERENCE TO RELATED APPLICATION

This application claims priority under 35 USC 119 from Japanese Patent Application No. 2005-73994, the disclosure of which is incorporated by reference herein.

BACKGROUND OF THE INVENTION

1. Field of the Invention

The present invention relates to a method of driving a liquid-drop-ejecting recording head which carries out recording of an image by ejecting liquid drops.

2. Description of the Related Art

As conventional liquid-drop-ejecting recording heads, there are inkjet recording heads which record an image by ejecting ink drops onto a recording sheet, and the like.

For example, in an inkjet recording head which carries out gradation expression by adjusting the amount of ink forming one pixel, a driving waveform corresponding to the density is selected and applied to a piezoelectric element, so as to adjust the amount of ink which is jetted-out.

In the case of using, as the driving waveform, an analog driving waveform in which the voltage amplitude and the time change are arbitrary, the range over which the dot diameter can be modulated can be made to be large, and it is also easy to jet-out the desired amount of ink. However, there are the problems that, due to an analog amplifier and other driving circuits, the driving circuits are large and a large amount of electric power is consumed.

Thus, in recent years, making the driving circuit more compact and less expensive and decreasing the amount of consumed electric power by using a binary digital driving waveform have been studied. In a binary digital driving waveform, the voltage amplitude is determined by the power source voltage, and the time change is determined by a time constant depending on the electrostatic capacitance C of a piezoelectric element and the on resistance R of a switching element. Therefore, the degrees of freedom of the driving waveform are greatly reduced, and it is very difficult to make to the range of modulation of the dot diameter large and to adjust the ink amount to the desired ink amount.

As a conventional technique for adjusting the ink amount in a wide range by using a digital driving waveform, Japanese Patent Application Laid-Open (JP-A) No. 11-170515 discloses a technique of adjusting the interval of a jetting pulse and a non-jetting pulse, so as to vary the ink drop volume while maintaining the ink drop speed.

Further, JP-A No. 11-170522 discloses a technique of changing the ink drop volume by changing the repetition frequency of the jetting pulse.

JP-A No. 2002-326357 discloses a technique of applying a main pulse after applying a supplementary pulse, and adjusting between these pulses so as to adjust the ink drop volume.

Moreover, JP-A No. 10-151770 discloses controlling the ink drop volume of a small drop region by voltage, and controlling the ink drop volume of a large drop region by the number of pulses.

However, in each of the techniques disclosed in the aforementioned JP-A Nos. 11-170515, 11-170522, and 2002-326357, there are the problems that the range of adjustment of the ink drop volume is narrow, and gradation expression in the high density range in particular cannot be carried out well. Further, the control is complex in the case of changing the repeat frequency as in JP-A No. 11-170522.

Moreover, the technique disclosed in JP-A No. 10-151770 has the problems that, because a circuit for carrying out voltage control is needed, the driving circuit becomes large and complex.

The technique disclosed in JP-A No. 10-151770 also has the problems that, when the number of pulses increases, the driving waveform becomes long, and the printing frequency decreases.

SUMMARY OF THE INVENTION

The present invention provides a method of driving a liquid-drop-ejecting recording head which can accurately carry out gradation expression by using a binary digital driving waveform.

A first aspect of the present invention is a method of driving a liquid-drop-ejecting recording head which, by applying a jetting pulse having a binary digital driving waveform to a piezoelectric element, provides a vibration wave to liquid accommodated in an accommodating chamber, and ejects a liquid drop from a eject opening, and carries out image recording, the method including: classifying each pixel in accordance with density data of the pixel into a density range among density ranges expressing low density, medium density and high density; and when recording a pixel belonging to the high density range, applying plural jetting pulses, whose pulse width is ½ times a natural vibration period of a liquid flow at a flow path of the liquid, within a single printing cycle at an interval which is set in advance in accordance with density data of the pixel.

In accordance with the above-described aspect of the present invention, when recording a pixel belonging to the high density range, plural jetting pulses, whose pulse width is ½ times a natural vibration period at a flow path of the liquid, are applied within a single printing cycle. Therefore, plural liquid drops are ejected, and the liquid drop amount of a pixel in the high density range is increased.

In accordance with the above-described aspect of the present invention, the interval at which the plural jetting pulses are applied is an interval which is set in advance in accordance with density data. Therefore, by setting the interval such that, the higher the density, the greater the amount of the liquid drop per pixel, it is possible to accurately carry out gradation expression particularly in the high density range by using a binary digital driving waveform.

BRIEF DESCRIPTION OF THE DRAWINGS

A preferred embodiment of the present invention will be described in detail based on the following figures, wherein:

FIG. 6 shows, per density level, parameters for generating a driving signal for each piezoelectric element by a recording head controller relating to the embodiment; FIG. 7A shows ink drop volume and FIG. 7B shows ink drop speed.

DETAILED DESCRIPTION OF THE INVENTION

In the present embodiment, explanation will be given of a case in which the present invention is applied to an inkjet recording head of a printer.

Figure 1:
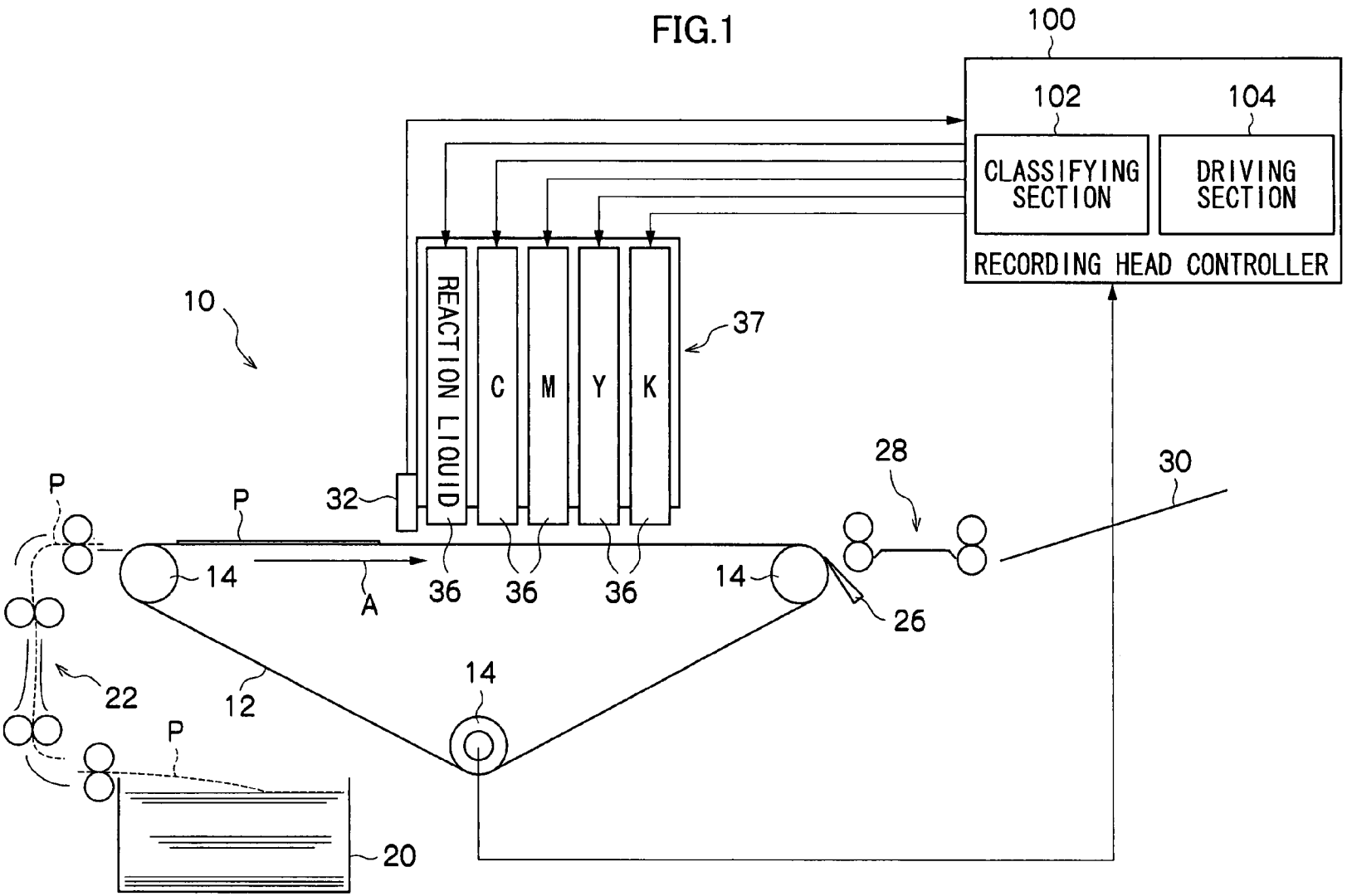
FIG. 1 is a schematic diagram showing the structure of an FWA-type inkjet printer relating to an embodiment.

The structure of an FWA (Full Width Array) type inkjet printer (hereinafter simply called "printer") 10 relating to the present embodiment is shown schematically in FIG. 1.

In the printer 10, a conveying belt 12 is trained about plural rollers 14, and circulates in the direction shown by arrow A in the drawing. Some of the plural rollers 14 are driving rollers which rotate by receiving driving force from a driving unit (not shown), whereas the other rollers are slave-rotated following the rotation of the driving rollers.

A sheet tray 20 is disposed at the printer 10. Recording sheets P for the recording of images are accommodated in a stacked manner in the sheet tray 20. The recording sheets P accommodated in the sheet tray 20 are, from the topmost one thereof, taken-out one-by-one by a pick-up mechanism (not shown), guided to a sheet feed conveying path 22, and fed-out to a predetermined position on the conveying belt 12 by the sheet feed conveying path 22. Note that the conveying belt 12 has a function of tightly holding the recording sheet P. In this way, the recording sheet P, which is fed-in by the sheet feed conveying path 22, is conveyed in the direction of arrow A in a state of being held tightly.

A recording head unit 37 is disposed along the conveying path of the recording sheet P, above the conveying belt 12 and at a conveying direction downstream side of the predetermined position where the recording sheet P is fed-in. The recording head unit 37 has, in order from the upstream side in the conveying direction of the recording sheet P by the conveying belt 12, five recording heads 36 for ejecting a reaction liquid, for ejecting cyan (C) ink, for ejecting magenta (M) ink, for ejecting yellow (Y) ink, and for ejecting black (K) ink. The recording sheet P which is being conveyed successively opposes the recording heads 36 of the respective colors.

A large number of ink ejecting nozzles 40 (shown in FIG. 2, but not FIG. 1) are disposed at the recording heads 36 of the respective colors. The ink ejecting nozzles 40 are lined-up over the entire transverse direction region of the conveying belt 12 which is orthogonal to the direction of arrow A.

The recording heads 36 are respectively driven by a recording head controller 100. The recording head controller 100 has a classifying section to which pixel data to be recorded is inputted, and which classifies each pixel in accordance with density data of the pixel into a density range among density ranges expressing low density, medium density and high density, and a driving section which applies jetting pulses to the recording head. On the basis of image data, ink drops of the respective colors are ejected from the ink ejecting nozzles 40 provided at the recording heads 36. In this way, the ink drops are ejected onto the recording sheet P, which is held tight to the conveying belt 12, by the recording heads 36 which successively oppose the recording sheet P, such that a full-color image is recorded on the recording sheet P.

The reaction liquid works to promote the abilities of the inks of the respective colors of CMYK to penetrate into the recording sheet P. The recording head 36 for ejecting reaction liquid carries-out a so-called pre-processing of carrying out liquid-drop-ejecting on all of the printing dots regardless of the image data. However, the recording head 36 for ejecting reaction liquid is not requisite for image formation.

A scraper 26 is provided on the conveying path of the recording sheet P by the conveying belt 12 at the downstream side of the recording head unit 37, so as to correspond to the position of placement of the roller 14 which is provided at the position where the conveying path bends. The scraper 26 separates the recording sheet P, for which image recording is completed, from the conveying belt 12, and feeds the recording sheet P out to a sheet eject tray 30 via a eject path 28.

Figure 2:
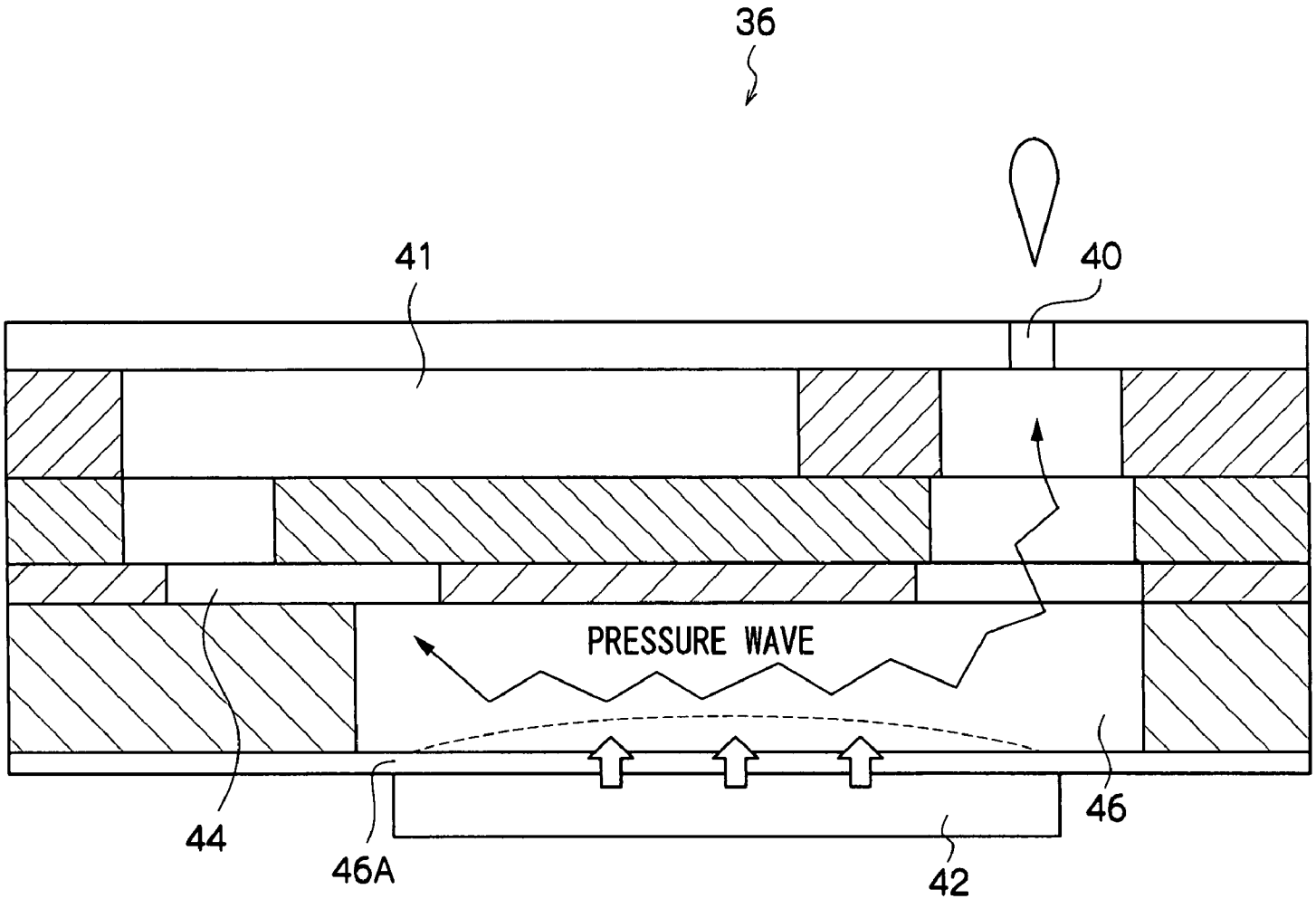
FIG. 2 is a cross-sectional view showing the structure of a recording head.

As shown in FIG. 2, the recording head 36 has the ink ejecting nozzle 40, an ink tank 41, a supply path 44, a pressure chamber 46 (accommodating chamber), and a piezoelectric element 42.

An appropriate amount of ink or reaction liquid (hereinafter collectively called "ink or the like" when appropriate) is supplied to the ink tank 41 from an ink cartridge (not shown), and is temporarily stored in the ink tank 41. The ink tank 41 communicates with the pressure chamber 46 via the supply path 44. The pressure chamber 46 communicates with the exterior via the ink ejecting nozzle 40.

A portion of the wall surfaces of the pressure chamber 46 are structured by a pressure adjusting plate 46A. The piezoelectric element 42 is mounted to the pressure adjusting plate 46A.

Due to the piezoelectric element 42 varying the pressing force with respect to the pressure adjusting plate 46A, the volume within the pressure chamber 46 is contracted or expanded. Namely, the ink or the like stored in the ink tank 41 is ejected from the ink ejecting nozzle 40 via the supply path 44 and the pressure chamber 46, due to the vibration waves of the ink or the like which are generated due to the change in the volume within the pressure chamber 46. Further, the piezoelectric element 42 is driven by the recording head controller 100 in accordance with a digital driving waveform.

The recording head controller 100 is connected to an AC power source (not shown), and is connected to each of the piezoelectric elements 42 provided at the recording heads 36. A switching element (not shown) is connected in series between the recording head controller 100 and each piezoelectric element 42. At the recording head controller 100, by turning the switching element on and off in accordance with a driving signal, a binary digital driving waveform is inputted to each piezoelectric element 42.

Note that the voltage amplitude of the driving waveform is determined by the power source voltage, and an electrostatic capacitance C exists in the piezoelectric element 42, and an on resistance R exists in the switching element. Therefore, a slope, which is determined by a time constant which depends on the electrostatic capacitance C and the on resistance R, is generated in the rise and the fall of the binary digital driving waveform.

In the present embodiment, by making the driving waveform of one printing cycle differ in accordance with the density data, the amount of ink forming one pixel is adjusted and gradation expression is carried out. A driving waveform, which corresponds to the density data of each pixel, is selected from among plural driving waveforms which are set in advance. The selected driving waveform is applied to the corresponding piezoelectric element 42, and the amount of ink ejected from each ink ejecting nozzle 40 is adjusted.

Here, there are set, in the present embodiment, driving waveforms of three patterns, which are a driving waveform for high density, a driving waveform for medium density, and a driving waveform for low density, in each of which jetting pulses P1 (see FIGS. 3 through 5) and non-jetting pulses P2 (see FIG. 5) are combined in advance. Each pulse structuring the driving waveform is formed from a first step (corresponding to the falling portion of the driving waveform shown in each figure) of expanding the pressure chamber 46, a second step (corresponding to the low level portion of the driving waveform shown in each figure) of maintaining the pressure chamber 46 as is in its expanded state, and a third step (corresponding to the rising portion of the driving waveform shown in each figure) of contracting the pressure chamber 46 to its original position. Further, the pulse widths of the jetting pulse P1 and the non-jetting pulse P2 are respectively different. Note that, in the present specification, pulse widths and intervals will be explained by using time periods, which are based on the timings of turning on and off the switching element, of the drive signal for inputting each driving waveform.

More specifically, a pulse width PW1 of the jetting pulse P1 is ½ of the natural vibration period (also called the Helmholtz frequency) of the ink flow. In this way, when the jetting pulse P1 is applied, the pressure chamber 46 is contracted at the time when the ink flow resonates in the period of entering and exiting the pressure chamber 46 due to the expansion of the pressure chamber 46. Therefore, the ink drop is ejected from the ink ejecting nozzle 40. On the other hand, a pulse width PW2 of the non-jetting pulse P2 is ¼ of the natural vibration period of the ink flow. In this way, when the non-jetting pulse P2 is applied, the pressure chamber 46 is contracted at the time when the ink flow does not resonate in the period of entering and exiting the pressure chamber 46 due to the expansion of the pressure chamber 46. Therefore, the ink drop is pulled into the pressure chamber 46 and is not ejected from the ink ejecting nozzle 40.

Hereinafter, the driving waveforms of the three patterns relating to the present embodiment will be described in detail. Note that, in the present embodiment, explanation will be given with one printing cycle being 50 μsec, and the natural vibration period of the ink drop being 12 μsec.

Figure 3A:
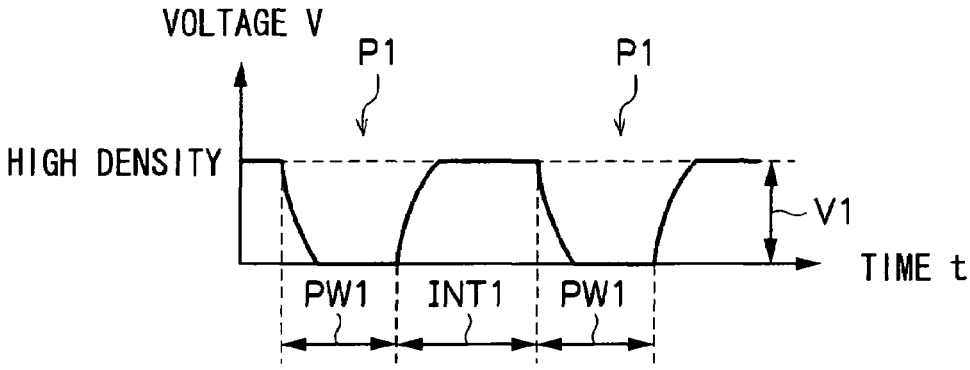
FIG. 3A is a diagram showing a driving waveform for a high density range.

A driving waveform for a high density range, which is applied to the piezoelectric element 42 in a case of recording a pixel of a high density range (high density portion), is shown in FIG. 3A. As shown in FIG. 3A, in the high density range, after the jetting pulse P1 is applied, an interval which is a predetermined interval INT1 is provided, and the second jetting pulse P1 is applied, such that a total of two jetting pulses P1 are applied.

In this way, when the first jetting pulse P1 is applied, one ink drop is ejected from the ink ejecting nozzle 40 due to the change in the volume of the pressure chamber 46. Thereafter, when the interval INT1 elapses, the second jetting pulse P1 is applied in continuation thereafter. Therefore, the two ink drops are ejected in continuation.

Figure 3B:
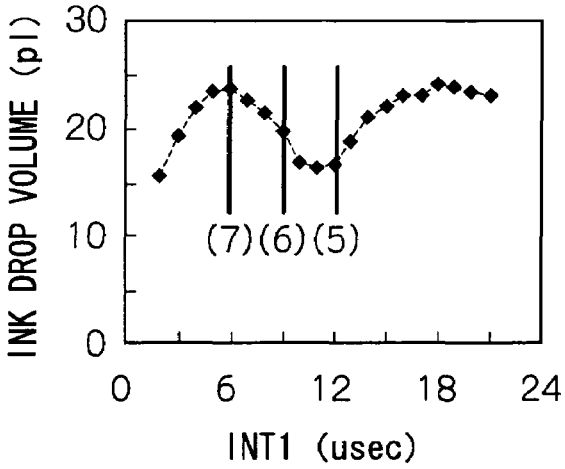
FIG. 3B is a diagram showing results of measurement of volume of an ink drop ejected from an ink ejecting nozzle 40 when an interval INT1 is varied.

FIG. 3B shows the results of measurement of the volume of the ink drop ejected from the ink ejecting nozzle 40 when the interval INT1 is varied, while using the recording head 36 relating to the present embodiment and with the voltage amplitude V being 15 V and the jetting pulse width PW1 being 6 μsec. As shown in FIG. 3B, it can be understood that when the interval INT1 is varied, the volume of the ink drop ejected from the ink ejecting nozzle 40 varies between about 17 pl to 24 pl.

Figure 3C:
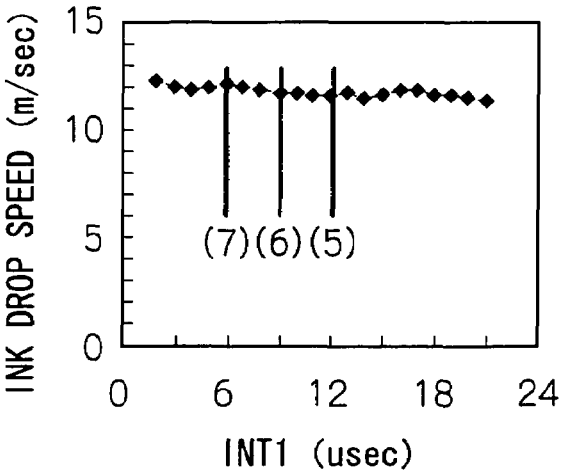
FIG. 3C is a diagram showing results of measurement of speed of an ink drop ejected from the ink ejecting nozzle 40 when the interval INT1 is varied.

FIG. 3C shows the results of measurement of the speed of the ink drop ejected from the ink ejecting nozzle 40 when the interval INT1 is varied, while similarly using the recording head 36 relating to the present embodiment and with the voltage amplitude V being 15 V and the jetting pulse width PW1 being 6 μsec. As shown in FIG. 3C, even if the interval INT1 is varied, the ink drop speed is substantially constant.

Figure 4A:
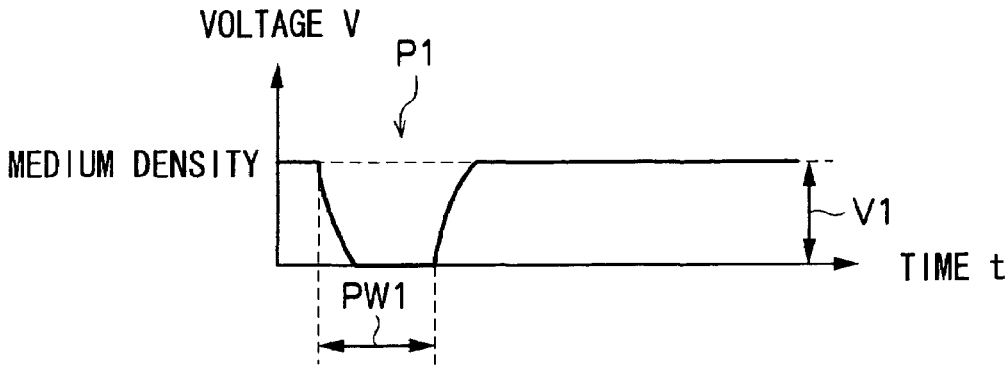
FIG. 4A is a diagram showing a driving waveform for a medium density range.

A driving waveform for a medium density range, which is applied to the piezoelectric element 42 in a case of recording a pixel of a medium density range (medium density portion), is shown in FIG. 4A. As shown in FIG. 4A, in the medium density range, one jetting pulse P1 is applied.

In this way, when the jetting pulse P1 is applied, one ink drop is ejected from the ink ejecting nozzle 40.

Figure 4B:
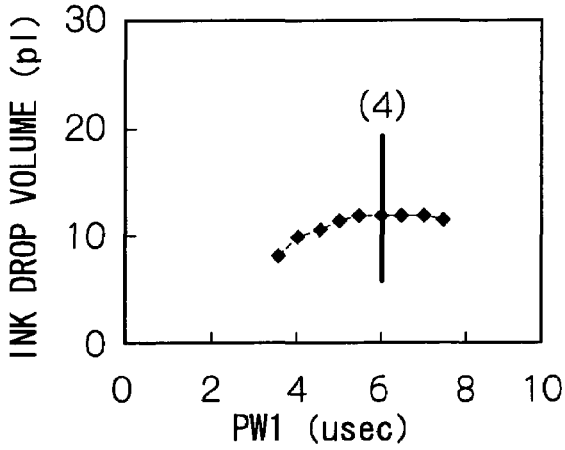
FIG. 4B is a diagram showing results of measurement of volume of an ink drop ejected from the ink ejecting nozzle 40 when a jetting pulse width PW1 is varied.

FIG. 4B shows the results of measurement of the volume of the ink drop ejected from the ink ejecting nozzle 40 when the jetting pulse width PW1 is varied, while using the recording head 36 relating to the present embodiment and with the voltage amplitude V being 15 V. As shown in FIG. 4B, it can be understood that when the pulse width PW1 is varied, the volume of the ink drop ejected from the ink ejecting nozzle 40 varies between about 8 pl to 12 pl.

Figure 4C:
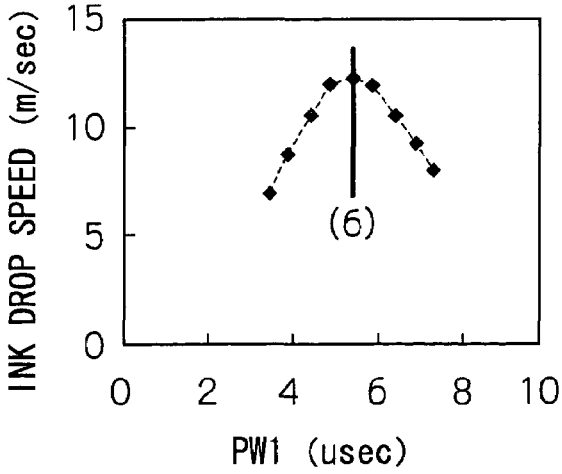
FIG. 4C is a diagram showing results of measurement of speed of an ink drop ejected from the ink ejecting nozzle 40 when the jetting pulse width PW1 is varied.

FIG. 4C shows the results of measurement of the speed of the ink drop ejected from the ink ejecting nozzle 40 when the jetting pulse width PW1 is varied, while similarly using the recording head 36 relating to the present embodiment and with the voltage amplitude V being 15 V. In this case, the speed of the ink drop varies greatly in accordance with the change in the jetting pulse width PW1.

Figure 5A:
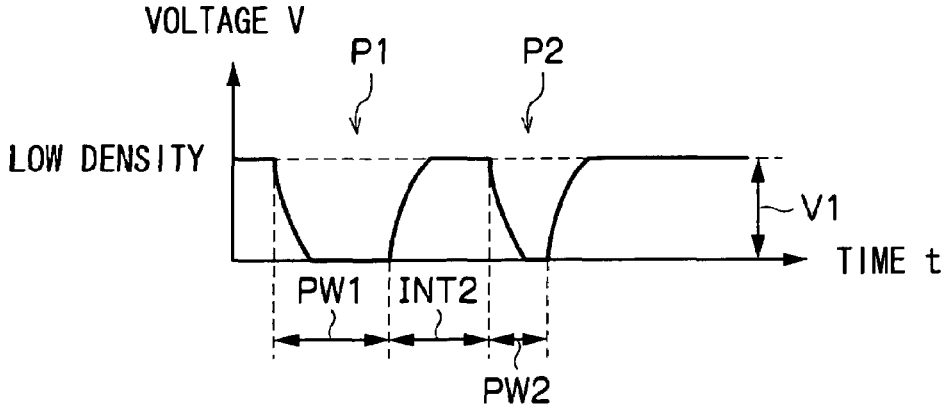
FIG. 5A is a diagram showing a driving waveform for a low density range.

A driving waveform for a low density range, which is applied to the piezoelectric element 42 in a case of recording a pixel of a low density range (low density portion), is shown in FIG. 5A. As shown in FIG. 5A, in the low density range, after the first jetting pulse P1 is applied, an interval which is a predetermined interval INT2 is provided, and the second non-jetting pulse P2 is applied.

In this way, when the first jetting pulse P1 is applied, one ink drop is ejected from the ink ejecting nozzle 40 due to the change in the volume of the pressure chamber 46. When the interval INT2 elapses, the non-jetting pulse P2 is applied in continuation thereafter, and a portion of the ink drop which is being ejected is pulled into the pressure chamber 46. Therefore, the volume of the ink drop is small as compared with a case in which only the one jetting pulse P1 is applied.

Figure 5B:
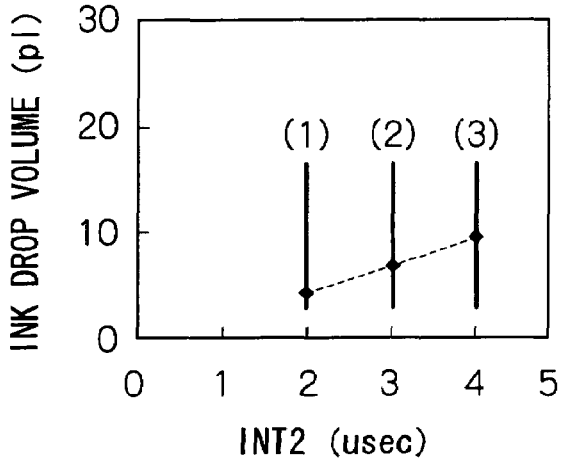
FIG. 5B is a diagram showing results of measurement of volume of an ink drop ejected from the ink ejecting nozzle 40 when an interval INT2 is varied.

FIG. 5B shows the results of measurement of the volume of the ink drop ejected from the ink ejecting nozzle 40 when the interval INT2 is varied, while using the recording head 36 relating to the present embodiment and with the voltage amplitude V being 15 V, the jetting pulse width PW1 being 6 μsec and the non-jetting pulse width PW2 being 2 μsec. As shown in FIG. 5B, it can be understood that when the interval INT2 is varied, the volume of the ink drop ejected from the ink ejecting nozzle 40 varies between about 4 pl to 10 pl.

Figure 5C:
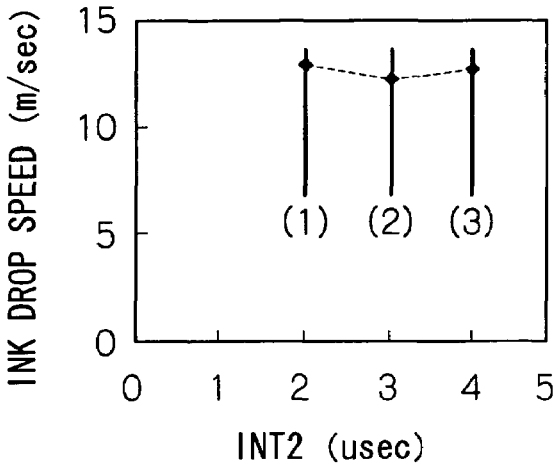
FIG. 5C is a diagram showing results of measurement of speed of an ink drop ejected from the ink ejecting nozzle 40 when the interval INT2 is varied.

FIG. 5C shows the results of measurement of the speed of the ink drop ejected from the ink ejecting nozzle 40 when the interval INT2 is varied, while similarly using the recording head 36 relating to the present embodiment and with the voltage amplitude V being 15 V, the jetting pulse width PW1 being 6 μsec and the non-jetting pulse width PW2 being 2 μsec. As shown in FIG. 5C, even if the interval INT2 is varied, the ink drop speed is substantially constant.

FIG. 6 shows, per density level, parameters for generating the driving signal of each piezoelectric element 42 by the recording head controller 100 relating to the present embodiment, which parameters are derived from the relationships among the jetting pulse width PW1, the interval INT1, and the interval INT2 shown in FIGS. 3 through 5.

Note that each density level expresses a density range which is set in advance, and can be specified in accordance with density data. Namely, at the recording head controller 100, a driving waveform is generated by using parameters corresponding to a density level (1 through 7) specified on the basis of the density data of the pixel, and is applied to the piezoelectric element 42. Further, the parenthetic numbers 1 through 7 showing the density levels in FIG. 6 correspond respectively to the parenthetic numbers in FIGS. 3 through 5, and the higher the number expressing the density level, the higher the density.

For example, in the case of density level 2, the parameters are V1=15 V, PW1=6.0, PW2=2.0, and INT2=3.0. Therefore, at interval INT2 after jetting pulse P1, the non-jetting pulse P2 is applied. The driving waveform for a low density portion is applied.

Further, in the case of density level 4, because the parameters are V1=15 V and PW1=6.0, only the one jetting pulse P1 is applied, and the driving waveform for a medium density range shown in FIG. 4A is applied.

In the case of density level 6, the parameters are V1=15 V, PW1=6.0, and INT1=9.0. Therefore, two jetting pulses P1 are applied at interval INT1, and the driving waveform for a high density range shown in FIG. 3A is applied.

Figure 7A:
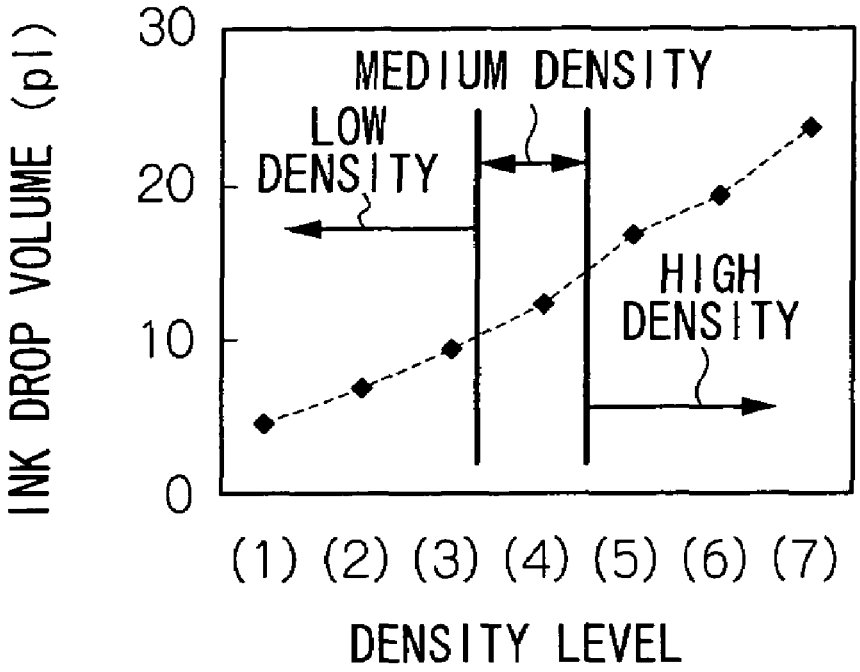
FIGS. 7A and 7B are diagrams showing results of measurement in cases in which driving waveforms, which are generated by using the parameters corresponding to the respective density levels relating to the embodiment, are applied to the piezoelectric element, where
Figure 7B:
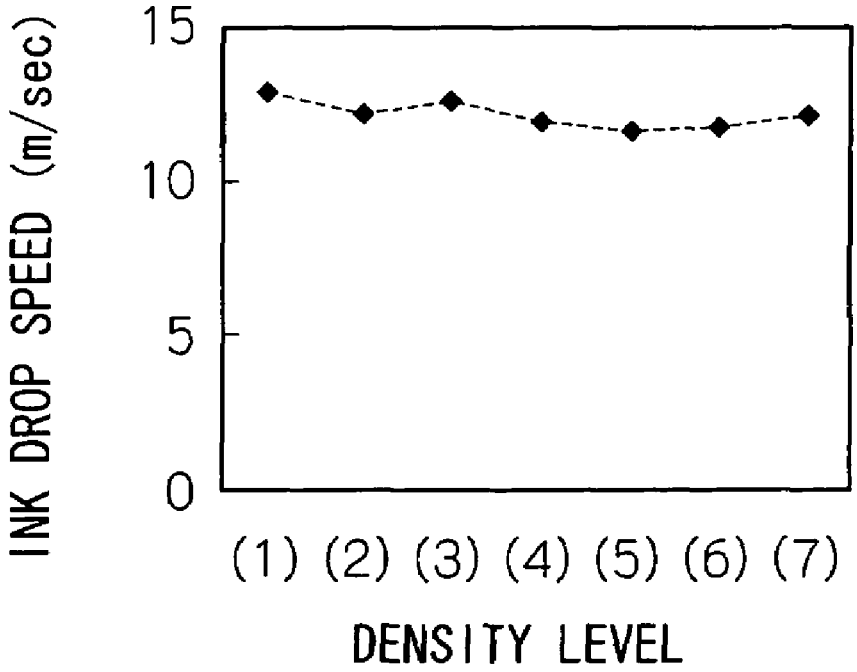

FIGS. 7A and 7B show ink drop volume (FIG. 7A) and ink drop speed (FIG. 7B) in cases in which driving waveforms, which are generated by using the parameters corresponding to the respective density levels, are applied to the piezoelectric element 42. As shown in FIG. 7A, by using the parameters corresponding to the respective density levels, the ink drop volume can be varied smoothly from 2 pl to 24 pl. Further, as shown in FIG. 7B, the ink drop speed at the respective density levels is in a vicinity of 12 m/sec and is substantially constant. Therefore, the ink drop volume can be varied smoothly without offset arising in the positions where the ink drops land. Thus, gradation expression from low density to high density can be carried out accurately.

The interval INT1 of the driving waveform for a high density range is set in a range of from ½ to 1 times the natural vibration period. Therefore, even if two of the jetting pulses P1 are applied, during the time until the next printing cycle, a sufficient period of time can be ensured for settling down the vibrations of the ink.

In the present embodiment, description is given of a case in which the interval INT1 of the driving waveform for a high density range is set in a range of from ½ to 1 times the natural vibration period. However, the present invention is not limited to the same, and the interval INT1 may be set in a range of from 1 to 3/2 times the natural vibration period.

Further, in the present embodiment, explanation is given of a case in which the liquid-drop-ejecting recording head ejects ink, but the present invention is not limited to a structure which ejects ink.

Note that the structure of the printer 10 in the present embodiment (refer to FIGS. 1 and 2) is an example, and can of course be modified appropriately.

The measured values shown in FIGS. 3 through 7 also are examples, and the respective values can be set appropriately in accordance with the specifications of the actual recording head, the natural vibration period at the flow path of the liquid which is ejected, and the like.

The present invention has been described above with reference to a specific embodiment, but the present invention is not to be interpreted as being limited to this embodiment.

Namely, a first aspect of the present invention is a method of driving a liquid-drop-ejecting recording head which, by applying a jetting pulse having a binary digital driving waveform to a piezoelectric element, provides a vibration wave to liquid accommodated in an accommodating chamber, and ejects a liquid drop from a eject opening, and carries out image recording, the method including: classifying each pixel in accordance with density data of the pixel into a density range among density ranges expressing low density, medium density and high density; and when recording a pixel belonging to the high density range, applying plural jetting pulses, whose pulse width is ½ times a natural vibration period of a liquid flow at a flow path of the liquid, within a single printing cycle at an interval which is set in advance in accordance with density data of the pixel.

In accordance with the first aspect, the interval at which the plural jetting pulses are applied is an interval which is set in advance in accordance with density data. Therefore, by setting the interval such that, the higher the density, the greater the liquid drop amount per pixel, it is possible to accurately carry out gradation expression particularly in the high density range by using a binary digital driving waveform.

As an example, in a case in which two jetting pulses are applied, the amounts of the two liquid drops are varied in accordance with the relationship between the aforementioned natural vibration period and the timing of applying the second jetting pulse.

There is the tendency that, when the interval is varied, the ejected liquid drop amount varies at the same cycle as the natural vibration period, e.g., when the interval is made to be 1 time the natural vibration period, the liquid drop amount becomes small, and when the interval is made to be ½ times or 3/2 times the natural vibration period, the liquid drop amount becomes large.

Thus, in the first aspect, it suffices to set the interval within the range of from ½ times to 3/2 times the natural vibration period, and preferable, to set the interval to from ½ times to 1 time the natural vibration period.

In this way, gradation expression of the high density range can be carried out accurately in accordance with the density data. In particular, when the interval is set to within a range of from ½ times to 1 time the natural vibration period, the interval can be set to be short. Therefore, the proportion of the time, within one printing cycle, which is occupied by the time for applying the jetting pulse is small, and, up until the next printing cycle, it is possible to ensure a sufficient period of time for the reverberations of the vibration to settle down.

Further, in the first aspect, when recording a pixel of the low density range, the jetting pulse and a non-jetting pulse, whose pulse width is smaller than the pulse width of the jetting pulse, may be applied successively in one printing cycle with a predetermined interval therebetween.

In such a case, plural predetermined intervals may be set in advance, and the predetermined interval can be selected in accordance with the density data of the pixel to be recorded.

In the first aspect, when recording a pixel of the medium density range, it is possible to apply a single jetting pulse.

A second aspect of the present invention is a liquid-drop-ejecting recording device having: a liquid-drop-ejecting recording head carrying out recording of an image by varying a volume of an accommodating chamber in which a liquid is accommodated by using a piezoelectric element driven by application of a jetting pulse having a binary digital driving waveform, and ejecting a liquid drop from a eject opening; and a recording head controller of the liquid-drop-ejecting recording head, wherein the recording head controller has: a classifying section to which pixel data to be recorded is inputted, and which classifies each pixel in accordance with density data of the pixel into a density range among density ranges expressing low density, medium density and high density, and a driving section which, when recording a pixel of the high density range applies jetting pulses, whose pulse width is ½ times a natural vibration period of a liquid flow at a flow path of the liquid, to the recording head plural times within a single printing cycle at an interval which is set in advance in accordance with density data of the pixel.

The second aspect has a similar operation as the first aspect. Therefore, in accordance with the second aspect, gradation expression can be carried out accurately by using a binary digital driving waveform.

As described above, the present invention has the excellent effect that gradation expression can be carried out accurately by using a binary digital driving waveform.

What is claimed is:

1. A method of driving a liquid-drop-ejecting recording head which, by applying a jetting pulse having a binary digital driving waveform to a piezoelectric element, provides a vibration wave to liquid accommodated in an accommodating chamber, and ejects a liquid drop from a eject opening, and carries out image recording, the method comprising:

classifying each pixel in accordance with density data of the pixel into a density range among density ranges expressing low density, medium density and high density; and when recording a pixel belonging to the high density range, applying a plurality of jetting pulses, whose pulse width is ½ times a natural vibration period of a liquid flow at a flow path of the liquid, within a single printing cycle at an interval which is set in advance in accordance with density data of the pixel.

2. The method of driving a liquid-drop-ejecting recording head of claim 1, wherein the interval is in a range of from ½ times to 3/2 times the natural vibration period.

3. The method of driving a liquid-drop-ejecting recording head of claim 1, wherein the interval is in a range of from ½ times to 1 time the natural vibration period.

4. The method of driving a liquid-drop-ejecting recording head of claim 1, wherein, when recording a pixel of the medium density range, only a single jetting pulse is applied.

5. The method of driving a liquid-drop-ejecting recording head of claim 1, wherein, when recording a pixel of the low density range, the jetting pulse and a non-jetting pulse, whose pulse width is smaller than a pulse width of the jetting pulse, are applied successively in one printing cycle with an predetermined interval therebetween.

6. The method of driving a liquid-drop-ejecting recording head of claim 5, wherein the predetermined interval is selected in accordance with the density data of the pixel to be recorded, from a plurality of intervals which are set in advance.

7. A liquid-drop-ejecting recording device comprising:

a liquid-drop-ejecting recording head carrying out recording of an image by varying a volume of an accommodating chamber in which a liquid is accommodated by using a piezoelectric element driven by application of a jetting pulse having a binary digital driving waveform, and ejecting a liquid drop from a eject opening; and a recording head controller of the liquid-drop-ejecting recording head, wherein the recording head controller has:

a classifying section to which pixel data to be recorded is inputted, and which classifies each pixel in accordance with density data of the pixel into a density range among density ranges expressing low density, medium density and high density, and a driving section which, when recording a pixel of the high density range applies jetting pulses, whose pulse width is ½ times a natural vibration period of a liquid flow at a flow path of the liquid, to the recording head plural times within a single printing cycle at an interval which is set in advance in accordance with density data of the pixel.

8. The liquid-drop-ejecting recording device of claim 7, wherein the interval is in a range of from ½ times to 3/2 times the natural vibration period.

9. The liquid-drop-ejecting recording device of claim 7, wherein the interval is in a range of from ½ times to 1 time the natural vibration period.

10. The liquid-drop-ejecting recording device of claim 7, wherein, when recording a pixel of the medium density range, only a single jetting pulse is applied.

11. The liquid-drop-ejecting recording device of claim 7, wherein, when recording a pixel of the low density range, the jetting pulse and a non-jetting pulse, whose pulse width is smaller than a pulse width of the jetting pulse, are applied successively in one printing cycle with an predetermined interval therebetween.

12. The liquid-drop-ejecting recording device of claim 11, wherein the predetermined interval is selected in accordance with the density data of the pixel to be recorded, from a plurality of intervals which are set in advance.

* * * * *